United States Patent [19]

Okamoto

[11] 4,232,073

[45] Nov. 4, 1980

[54] FIBROUS SHEET MATERIALS RESEMBLING A DEER SKIN AND PROCESS FOR PREPARING SAME

[75] Inventor: Miyoshi Okamoto, Takatsuki, Japan

[73] Assignee: Toray Industries, Inc., Tokyo, Japan

[21] Appl. No.: 942,806

[22] Filed: Sep. 15, 1978

Related U.S. Application Data

[63] Continuation-in-part of Ser. No. 831,047, Sep. 6, 1977, Pat. No. 4,127,696, which is a continuation-in-part of Ser. No. 745,161, Nov. 26, 1976, abandoned.

[30] Foreign Application Priority Data

Jun. 17, 1976 [JP] Japan ..... 51-70379

[51] Int. Cl.[2] ..... B29D 27/00

[52] U.S. Cl. ..... 428/91; 26/29 R; 428/904

[58] Field of Search ..... 428/16, 91, 904; 26/29 R

[56] References Cited

U.S. PATENT DOCUMENTS

| | | | |
|---|---|---|---|
| 3,705,226 | 12/1972 | Okamoto et al. | 428/904 |
| 3,865,678 | 2/1975 | Okamot o et al. | 428/91 |
| 4,118,529 | 10/1978 | Nakagawa et al. | 428/91 |
| 4,136,221 | 1/1979 | Okamota et al. | 428/91 |

FOREIGN PATENT DOCUMENTS 46-37198 11/1971 Japan .

*Primary Examiner*—Marion McCamish
*Attorney, Agent, or Firm*—Cushman, Darby & Cushman

[57] ABSTRACT

Disclosed are an improved islands-in-a-sea type multi-core composite filament comprising at least two different polymer components and having a cross-section wherein each island is surrounded by some other islands and most of the islands have an approximately quadrilateral to hexagonal cross-section, and also a process for producing the above-said composite filament. Using the multi-core composite filaments, fibrous sheet materials resembling a deer skin and having an excellent quality can be obtained.

9 Claims, 5 Drawing Figures

FIBROUS SHEET MATERIALS RESEMBLING A DEER SKIN AND PROCESS FOR PREPARING SAME

This application is a continuation-in-part of application Ser. No. 831,047, filed on Sept. 6, 1977, which issued as U.S. Pat No. 4,127,696 on Nov. 28, 1978 and, which, is in turn, a continuation-in-part of application Ser. No. 745,161, filed on Nov. 26, 1976 now abandoned.

SUMMARY OF THE INVENTION

The invention relates to improved multi-core composite filaments and to fibrous sheet materials resembling a deer skin comprising extra fine fibers having polygonal cross-sections.

Various types of islands-in-a-sea type multi-core composite filaments have been heretofore known. For example, there are the filaments of the types disclosed in U.S. Pat. Nos. 3,562,374, 3,531,368, 3,707,341, 3,641,232 and 3,188,689. These known composite filaments are different from the multi-core composite filaments of the present invention, as hereinbelow described, in the points that in the known filaments the sea component ratio is too high, the cross-sections of the islands in the sea component are round and the islands are arranged on only one circle in the filament cross-section. Suede-like fibrous sheets have also been known, for example, those disclosed in U.S. Pat. Nos. 3,562,374, 3,706,613 and 3,865,678.

The object of the present invention is to provide a multi-core composite filament of new type, more particularly to provide an islands-in-a-sea type multi-core composite filament of a novel configuration wherein the cross-sections of the islands are of a polygonal shape as is seen in natural deer skin or wool.

The inventor has studied an electron microscope photograph of high magnification of a cross-section of natural deer skin and, as a result, has made the following observations which he believes is new knowledge.

A. The packing density of the fiber bundles in the sheet is high, i.e. the apparent density is high.

B. Individual fibers have cross-sections of polygonal shape such as quadrilateral to nonagonal shape, wherein the angles of the polygonal shape are not sharp.

C. Individual fibers have an appearance different from that of fibers having approximately circular cross-sections.

In the attached drawings, FIG. 1 is a sketch of a scanning type electron microscope photograph of a cross-section of tanned natural deer skin. It is seen from the figure that the individual extra fine fibers have cross-sections of polygonal shape and the sheet is composed of fiber bundles wherein the number of fibers is not too large but not too small.

Bundles of extra fine fibers having polygonal cross-sections as in natural collagen fibers could not have hitherto been obtained, because there were no definite means for obtaining such fiber bundles. It has hitherto been believed that in order to obtain lobular fibers it is necessary to employ nozzles having a modified non-circular cross-section during the spinning. Attempts have been made to obtain lobular fibers by applying a composite spinning technique. However, the desired fiber bundles have not yet been obtained successfully owing to technical difficulties, particularly the difficulty of forming inner islands having polygonal cross-sections.

It is another object of the present invention to provide an islands-in-a-sea type composite filament which is hard to get lean when the sea component is removed to obtain a bundle of extra fine filaments, so that a fabric constituted from the filament bundle can have an excellent massive appearance and resilience.

It is still another object of the present invention to achieve economy in resources and energy consumption by reducing the loss of the sea component.

It is a further object of the present invention to provide a fibrous sheet material having an appearance and configuration which closely resemble those of natural deer skin, which could have never been hitherto obtained artificially.

The above-mentioned objects can be attained by the following construction of the present invention.

The present invention provides an islands-in-a-sea type multi-core composite filament comprising at least two different polymer components and having a cross-section wherein each island is surrounded by some other islands, characterized in that the sea component is contained in an amount less than 35% based on the weight of all components and most of the islands have an approximately quadrilateral to hexagonal cross-section.

Preferably, the sea component is contained in an amount of less than 10% by weight. It is also preferable that the cross-sections of the islands positioned at the most outside portion of the filament are of approximately quadrilateral or pentagonal shape and the cross-sections of the inner islands surrounded by the outside islands are of approximately quadrilateral to nonagonal shape.

The present invention further provides a sheet-like material comprising fiber bundles of mixed extra fine fibers having approximately quadrilateral to nonagonal cross-sections, in which bundles a majority of the fibers positioned at the inside portion have cross-sections of a greater number of angles than the number of angles of cross-sections of the fibers positioned at the outside portion, said sheet-like material having, on the surface thereof, raised fibers composed of protruding ends of the extra fine fibers and having a polymeric binder material impregnated therein.

The sheet-like material of the present invention may be prepared by a process comprising, forming a fibrous sheet comprising islands-in-a-sea type multi-core composite fibers of at least two different polymer components, containing the sea component in an amount less than 10% based on the total weight of the polymer components and having cross-sections of approximately quadrilateral or pentagonal shape in the islands positioned at the most outside portion of each of said fibers and of approximately quadrilateral to nonagonal shape in the inner islands surrounded by said outside island, impregnating the fibrous sheet with a solution or dispersion of a polymeric binder material and, then, coagulating or hardening the polymeric binder material, and thereafter, subjecting the impregnated fibrous sheet to raising.

The multi-core composite filaments and the sheet-like materials according to the present invention have the following characteristics and effects.

1. Since the islands of the filament have polygonal cross-sections and the filament has a configuration wherein each island is surrounded by other islands, as is seen in the configuration of the cell or fibril of wool or the configuration of deer skin, the suede-like products obtained from the multi-core composite filaments have a feel and an appearance similar to natural deer skin.

2. The processability in spinning and drawing is similar to that of the island component polymer.

3. The amount of the sea component to be removed is small and a solvent to be used for the removal of the component is either not necessary or the amount thereof is small. As a result, environmental pollution is reduced and economy in energy consumption can be realized.

4. Since the filaments which compose, for example, a knitted, woven or non-woven fabric, being hard to get lean when the sea component is removed, a dimensionally stable and dense sheet-like material can be obtained.

5. The surface luster and distortion property of the fine filaments obtained after the removal of the sea component, and the falling-off property of the fine fibers from an entangled body composed of the staple fine filaments obtained after removing the sea component, are unique and rather different from the case of the analogus filaments having circular cross-sections.

6. The multi-core composite filament can be effectively heat set during texturing, even before the removal of the sea component, because of the high content of the island component and, thus, can have high crimpability. Therefore, a fabric obtained using the textured composite filaments can easily generate high crepe.

7. The sea component can easily be removed only by mechanically beating, buffing or raising the composite filament and shaking off the peeled sea component. Thus, in the case where the fine filament bundle, which is obtainable by removing the sea component, is to be used, it is possible to subject the composite filament per se to usual processes without passing through a step for removing the sea component.

8. Even if a polymer of low melting point, for example, polystyrene or a copolymer of styrene and another vinyl monomer, is employed as the sea component, the staining of the heating plate for drawing is hardly even observed and, thus, troubles which may be caused by such staining can be avoided.

9. The feeding of the sea component can be carried out by a very small apparatus as compared with the apparatus for feeding the island component.

10. The multi-core composite filament can easily be divided into fine filaments composed of the island component, and paper and felt can easily be made using the composite filament.

11. It becomes unnecessary to employ a thickener, which has been conventionally necessary, to temporarily fix the configuration of a fibrous sheet upon the removal of the sea component or the impregnation of the polymeric binder material.

DETAILED DESCRIPTION OF THE INVENTION

Figure 1:
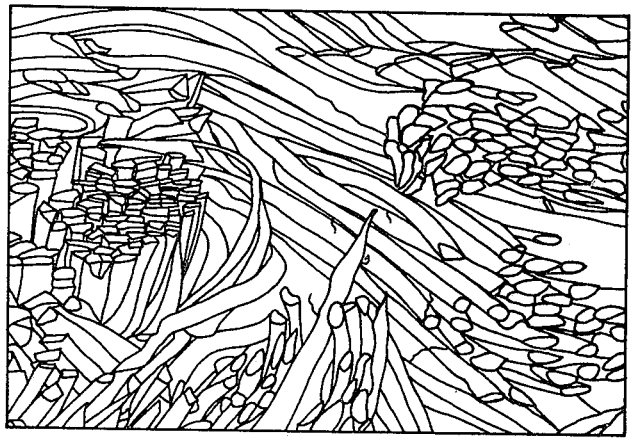

The invention is explained in detail below.

The term "fibrous sheet" as used herein, refers to woven fabrics, knitted fabrics and various types of non-woven fabrics. Particularly, a fibrous sheet obtained by a non-weaving process, such as a needle punched non-woven fabric, a tricot knitted fabric including a plush or satin knitted fabric, a web produced by a water jet machine or the like, is preferably employed in the present invention.

The multi-core composite filament of the present invention may contain the sea component in an amount of less than 35%, preferably less than 10%, more preferably less than 5%, by weight. In the case where the sea component content is not less than 35% by weight, the cross-sections of the islands of the resulting filament become too round, so that the objects of the present invention can not be attained. In the present invention, since the islands are interacted, so as to be deformed, due to the limited intervals between the islands owing to the highness of the island component content, the islands easily have approximately quadrilateral or pentagonal cross-sections at the most outside portion of the resulting filament and approximately quadrilateral to nonagonal cross-sections at the inner portion. In order to obtain such a composite filament, the inner holes of the spinneret to be used should preferably be arranged so as to easily obtain the desired cross-sections of the islands.

In the composite filament of the present invention, if the sea component is in an amount of less than 5% by weight, the sea component can easily be peeled off by mechanical action without using a solvent.

As the sea and island component polymers, any fiber-forming polymers may be employed. Preferred polymers are those which have been known as polymers for multi-core composite filaments, for example, polyesters, polyamides, polyacrylonitriles, polyurethanes, polyolefins and polystyrene. It is particularly preferable that polyethylene terephthalate be used as the island component and polystyrene or a copolymer of styrene and another vinyl monomer be used as the sea component. The polyethylene terephthalate may be a polyethylene terephthalate copolymer containing a sulfonated isophthalic acid component.

The thickness and distribution of each island in the composite filament of the present invention are not critical. For example, the islands may have various thicknesses different from one another.

The multi-core composite filament of the present invention may have a circular cross-section or may have a cross-section of trilobal, tetralobal, T or hollow shape. In any case, the islands positioned at the most outside portion of the composite filament always have approximately quadrilateral or pentagonal cross-sections due to the interfacial tension yielded during the spinning. On the other hand, the inner islands may have approximately quadrilateral to nonagonal cross-sections due to the very low content of the sea component.

The number of the islands is preferably 7 to 1,000, and more preferably 10 to 200. The denier of each of the islands is preferably 0.0001 to 3, and more preferably 0.01 to 1.5.

The multi-core composite filament of the present invention may be produced by forming a composite stream consisting of at least two different polymers, wherein a multiplicity of island component streams composed of one or more of the polymers are distributed in a sea component stream of the other polymer, so that said island component streams are arranged on two or more concentric circles, with a content of said island component of no less than 65%, preferably no less than 90%, based on the total weight of the polymers, and ejecting the composite stream from a spinning orifice.

In the process, preferably only the sea component is ejected at the initial stage of the spinning. After confirming the stable discharge of the sea component from the spinning orifice, ejection of the island component is started. Then, the ejected weight ratio of the island component to the sea component is gradually increased to finally attain the desired content of the island component.

Preferably, there may be employed for the practice of the process a spinneret as shown in FIG. 9 of U.S. Pat. No. 3,692,423 or British Pat. No. 1,302,584. The spinneret may be modified by removing the first plate (29) or providing several projections at the inlet portion of the third plate (31) to disturb the flow of the sea component stream.

Further, in the case where the thickness of the sea component layer positioned at the surface portion of the resulting composite filament is to be increased, any one of the spinnerets as shown in FIGS. 12 to 16 of U.S. Pat. No. 3,692,423 may effectively be employed. Also, the means as disclosed in Japanese Patent Publications No. 44-13208 may be employed for the practice of the process according to the present invention.

One of the underlying principles of the process of the present invention is summarized in claim 6 of U.S. Pat. No. 3,531,368.

In order to spin the filament stably for a long time, it is suitable to employ a spinneret having a spinning orifice of large diameter. For example, in the case where the spinning orifice has a circular cross-section, the diameter of the spinning orifice is preferably no less than 0.5 mm, more preferably no less than 1.0 mm, and even more preferably no less than 1.2 mm. Further, it is important to employ sea and island component polymers having close values of viscosity. For example, where the combination of a styrene polymer and polyethylene terephtalate is employed, the ratio of the intrinsic viscosity of polyethylene terephthalate to the intrinsic viscosity of the styrene polymer is preferably in a range between 0.63 and 1.10. Preferable ratios of the intrinsic viscosity of polyethylene terephthalate to the intrinsic viscosity of the styrene polymer are, for example, 0.66:0.64, 0.71:0.87, 0.80:0.95, 0.60:0.99 and 0.71:0.64, in which the intrinsic viscosity of polyethlene terephthalate is a value measured in orthochlorophenol at 25° C. and that of the styrene polymer is a value measured in toluene at 30° C. Polystyrene having no less than 0.87 is particularly preferably employed. It should, however, be noted that the above-mentioned ratios may be varied depending upon the spinning conditions employed such as the spinning temperature and cooling condition.

In FIGS. 2 through 5 of the attached drawings, examples of the multi-core composite filament obtained by the above-mentioned process are shown.

Figure 2:
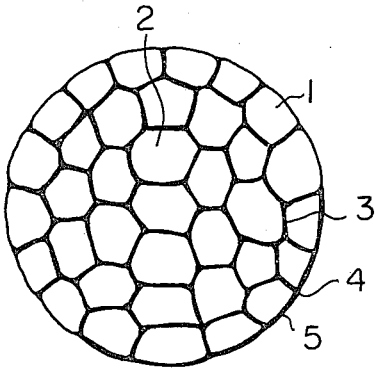

FIG. 2 is a schematic cross-sectional view of a multi-core composite filament containing 3.8% by weight of sea component and 96.2% by weight of island component and having 36 islands.

Figure 3:
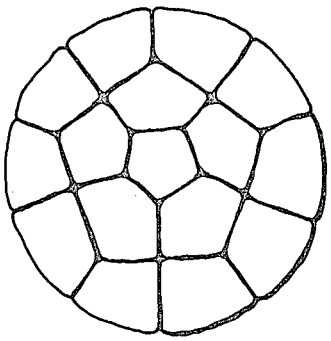

FIG. 3 is a schematic cross-sectional view of another multi-core composite filament containing 3.0% by weight of sea component and 97.0% by weight of island component and having 16 islands.

Figure 4:
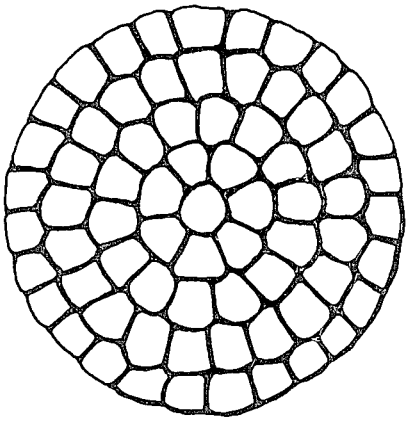

FIG. 4 is a schematic cross-sectional view of a further multi-core composite filament containing 3.0% by weight of sea component and 97.0% by weight of island component and having 70 islands.

Figure 5:
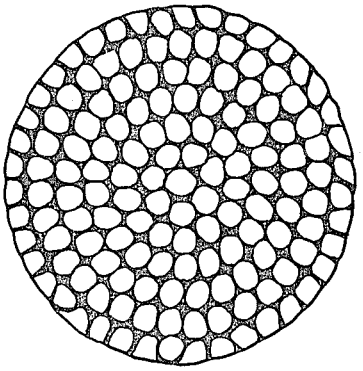

FIG. 5 is a schematic cross-sectional view of a further multi-core composite filament containing 1.7% by weight of sea component and 98.3% by weight of island component and having 145 islands.

In FIG. 2, 1 denotes an island positioned at the most outside portion of the filament. The most outside islands have approximately quadrilateral or pentagonal cross-sections. 2 denotes an inner island, and each of the inner islands has an approximately quadrilateral to nonagonal cross-section. 3 is the sea component positioned at the boundaries between the islands. The sea component shown by 4 makes the corners of the polygonal islands slightly round. 5 is the sea component positioned at the surface portion of the filament. In this example, this portion is a very thin layer and the thickness of this layer is of an order which can only be observed by a scanning type electron microscope, and can not be observed by a usual light microscope.

The multi-core composite filament of the present invention can advantageously be used for simulated synthetic leather, knitted fabrics, woven fabrics, felt, filters, paper, and materials for furniture, wall decoration, sporting goods, medical supplies and the like.

Examples of the polymeric binder material to be impregnated into the fibrous sheet include polyurethanes, acrylic binders, natural and synthetic rubbers such as acrylonitrile-butadiene rubber, styrene-butadiene rubber, silicone rubber and fluororubber, polyamide binders and epoxy binders, of which polyurethanes are particularly preferred. The rubbers may be formed by crosslinking after the impregnation into the fibrous sheet.

The amount of the polymeric binder material to be impregnated is preferably 5 to 60%, more preferably 10 to 40% by weight of the weight of the fibrous sheet. Preferably, the fibrous sheet has an apparent density of not less than 0.16 g/cm$^3$, before the impregnation of the polymeric binder material.

The fibrous sheet impregnated with the polymeric material may then by subjected to raising to form raised fibers composed of protruding ends of the extra fine fibers on the surface thereof.

The process for the preparation of the sheet-like material according to the invention may preferably be carried out by the following sequences of steps.

I. N→G→U→K
II. N→U→G→K
III. N→U→K→G→K
IV. N→G→K
V. N→K→G→K in which N is a step for forming the fibrous sheet using the islands-in-a-sea type multi-core composite fibers, G is a step for impregnating the fibrous sheet with the solution or dispersion of the polymeric binder material, U is a step for removing the sea component chemically or mechanically, and K is a step for forming raised fibers on the fibrous sheet surface by combing, buffing or loop cutting.

In addition to the above-mentioned steps, other treatments may naturally be carried out, such as treatments for contraction, fixation, compression, dyeing and finishing, oiling, heat setting, removal of solvent, removal of fixing agent, combing, lustering and shearing.

In the process for the preparation of the sheet-like material according to the present invention, the sea component of the multi-core composite fiber may easily be separated from the island component to form an extra fine fiber bundle, without subjecting the composite fiber to a particular step for the removal of sea component, through a mechanical shock suffered, for example, in the raising step during the process. Also, the sea component may optionally be removed by being dissolved in the solvent for the polymeric binder material in the impregnation step of the polymeric binder material.

The sheet-like materials of the present invention have many uses, such as for clothing, for example, blazers, coats, vests, shoes, hats or caps and gloves, for bags and luggage, for example, bags, handbags and trunks, for interior articles, for example, wall cloths, interior cloths, chair covers, beds and carpets, for industrial materials, for example, piano parts, packings, filters and grinding materials, for ornaments, for example, artificial flowers and jewelry boxes, and for sporting articles.

The invention will now be further illustrated by the following non-limitative examples.

EXAMPLE 1

Multi-core composite filaments were spun under the following conditions.

Island component
polyethylene terephthalate having an intrinsic viscosity of 0.70, measured in ortho-chlorophenol at 25° C.

Sea component
polystyrene having an intrinsic viscosity of 0.869, measured in toluene at 30° C.

Number of islands
36 per filament.

Ratio of island components to sea component
96.2:3.8 (by weight)

Spinning temperature
285° C.

Take-up rate
1,300 m/min.

The spun filaments were taken up into yarns while being heated by a heating tube provided immediately below the used spinneret. The undrawn yarns were then bundled and drawn with steam, crimped in a stuffing box and cut into staples in a usual manner. The draw ratio was 3.1. The obtained staples had a cross-section of regularly arranged islands, as shown in FIG. 2, wherein the islands on the most outside circle were of approximately quadrilateral or pentagonal cross-section and the inner islands were of approximately pentagonal or hexagonal cross-section. Each staple had 14 crimps per 25 mm and a length of 51 mm. At the bends of the crimps, the islands were partially divided due to the cracking of the sea component, so that the staples were very soft to the touch.

The staples were formed into a web of a weight of 470 g/m$^2$, using a carding machine and a cross-wrapper, and the web was then needle punched to form a felt of an apparent density of 0.198 g/cm$^3$. The felt was impregnated with a 12% aqueous solution of polyvinyl alcohol and dried. Then, the felt was immersed into trichloroethylene and immediately thereafter squeezed on a mangle. The immersing and squeezing were repeated 4 times and then the felt was dried. The measurement of the reduced weight of the obtained felt proved that polystyrene was substantially completely removed from the staples of the felt. During the above-mentioned treatment, the reduction of the felt thickness was very small and, thus, it was confirmed that the sea component could be very efficiently removed without any trouble.

The felt was then impregnated with polyurethane and the polyurethane was coagulated. Then, the obtained sheet was subjected to buffing. Observation of the obtained sheet by an electron microscope showed that the configuration of the sheet was just like that of natural deer skin. The sheet was excellent in softness, massive appearance and resilience, and the raised fibers of the surface thereof were hard to entangle and had a dull but deep luster.

EXAMPLE 2

In a manner analogous to that of Example 1, except that the number of islands was 16 and copolymer of styrene and 2-ethylhexyl acrylate (78:22) was used as the sea component, similar results to those of Example 1 were obtained. The raised fibers were almost upright and the color of the sheet had depth.

EXAMPLE 3

Multi-core composite filaments of a number of islands of 36 and of a ratio of island component to sea component of 97:3 (by weight) were spun with the polymer combination described in Example 2. The filaments were then drawn in warm water of 65° C., at a draw ratio of 2.8, and crimped and cut into staples in a usual manner. Each staple had 15 crimps per 25 mm and a length of 51 mm.

The staples were formed into a web of a weight of 600 g/m$^2$ using a carding machine and a cross-wrapper, and the web was then needle punched to form a felt of an apparent density of 0.21 g/cm$^3$. The fibers were only slightly cracked at the bends of the crimps and exhibited excellent felt-formability.

The felt was then immersed into hot water of 82° C. and dried. The felt was coated with a silicone emulsion, impregnated with a 13% solution of polyurethane in dimethylformamide and, then, subjected to coagulation in water for one hour. After drying, the felt was sliced into two sheets and both surfaces of the respective sheets were buffed. The sheets were then dyed a black shade with a disperse dye.

The obtained sheets had raised fibers being hard to entangle and a moderate luster, and closely resembled a high quality natural suede having a voluminous appearance, a soft and gentle feel and a natural lighting effect.

EXAMPLE 4

Multi-core composite filaments were spun under the following conditions.

Island component
polycapramide having a relative viscosity of 2.8 (viscosity ratio of a 1.0% solution of the polymer in concentrated sulfuric acid to the concentrated sulfuric acid).

Sea component
polystyrene having an intrinsic viscosity of 0.869, measured in toluene at 30° C.

Number of islands
16 per filament.

Ratio of island component to sea component
96.8:3.2 (by weight)

Spinning temperature: 285° C.

Take-up rate: 1,280 m/min

The spun filaments were drawn using a fish-tail spray at a steam temperature of 105° C. and a hot plate temperature of 140° C., and at a draw ratio of 3.5, and then, crimped and cut to obtain staples of a fineness of 5.1 denier and a length of 51 mm. The obtained staples had a cross-section as shown in FIG. 3.

The staples were formed into a web of a weight of 540 g/m$^2$ in a usual manner and the web was then needle punched to form a felt of an apparent density of 0.201 g/cm$^3$. After treatment with toluene, the felt was impregnated with an acrylic binder ("Ultrasol", made by Takeda Pharmaceutical Industries, Inc., Japan), dried at 140° C. and, then, sliced into sheets. Then, both surfaces of the respective sheets were buffed with a No. 150 emery paper to a thickness of 0.66 mm and they were dyed a red shade using an acid dye.

The obtained sheets had a thickness of 0.78 mm. The raised fibers were straight. The sheets were highly lustrous and had a deep and clear shade.

EXAMPLE 5

A drawn yarn of 75 denier/24 filaments was obtained by spinning under the conditions that the island component was polyethylene terephthalate (copolymerized with 10% of isophthalic acid), the sea component was polycapramide, the ratio of island component to sea component was 95:5 and the number of islands was 145, and then drawing. The cross-sections of the component filaments were as shown in FIG. 5.

Using this multifilament yarn as weft and an ordinary polyethylene terephthalate yarn of 75 denier/24 filaments as warp, a 5-harness satin weave was made. The fabric was then raised and coated with a room temperature curable silicone rubber diluted by trichloroethylene in an amount of 8% by weight of the silicone rubber based on the weight of the fabric. The fabric was immersed into a liquid of calcium chloride in methanol and then into an aqueous solution of calcium chloride, washed with water and dried. The fabric was then buffed with an emery paper. Then, the fabric was dyed at 115° C. using a disperse dye, Kayalon Polyester Gray NGL-S (made by Nippon Kayaku Co., Ltd., Japan).

The obtained fabric had an excellent resilience, no thread slippage and dense surface naps (i.e. raised fibers). The fabric had a very high quality and voluminous appearance having a moderate luster.

EXAMPLE 6

A tricot satin fabric was made using as a front yarn a multifilament yarn of 85 denier/24 filaments, each filament having an island component of polyethylene terephthalate having 2.5 mols of copolymerized sulfosodium isophthalic acid, a sea component of polystyrene having 22% of copolymerized octyl acrylate, a number of islands of 10 and a ratio of island component to sea component of 98.3:1.7, and; as a back yarn an ordinary polyethylene terephthalate multifilament yarn of 75 denier/24 filaments.

The knitted fabric was coated with 1% by weight of an oiling agent of lauryl ether having 3% mol of ethylene oxide added, and, after standing overnight, was subjected to raising. Then, it was coated with 14% by weight of a polyurethane emulsion. The fabric was then buffed using an emery paper, dyed with a basic dye, Cathilon Pink FGH (made by Hodogaya Kagaku Co., Ltd., Japan), brushed and dried.

The obtained fabric had dense surface naps, moderate softness, resilience and voluminous appearance, and well balanced wale and course. No knitted weave was observed on the surface thereof. Thus, the fabric was suitable for high fashion clothing.

What is claimed is:

1. A sheet-like material comprising bundles of mixed extra fine fibers having approximately quadrilateral to nonagonal cross-sections, in which bundles each extra fine fiber is surrounded by other extra fine fibers, a majority of the fibers positioned at the inside portion have cross-sections of a greater number of angles than the number of angles of the cross-sections of the fibers positioned at the outside portion and each extra fine fiber has peripheral surfaces to be faced approximately parallel, in a coherent state to the peripheral surfaces of the other extra fine fibers adjacent to said each extra fine fiber, said sheet-like material having, on the surface thereof, raised fibers composed of protruding ends of the extra fine fibers and having a polymeric binder material impregnated therein, said sheet-like material being of the group consisting of non-woven and knitted sheet-like materials.

2. A sheet-like material according to claim 1, wherein said polymeric binder material is polyurethane.

3. A sheet-like material according to claim 1, wherein the number of the extra fine fibers present in each of said fiber bundles is 7 to 1,000.

4. A sheet-like material according to claim 1, wherein the denier of each of said extra fine fibers is 0.01 to 1.5.

5. A sheet-like material according to claim 1, wherein said extra fine fibers are composed of polyester or polyamide.

6. A process for the preparation of a sheet-like material of the group consisting of non-woven and knitted sheet-like materials, which comprises:

forming a fibrous sheet comprising islands-in-a-sea type multi-core composite fibers of at least two different polymer components, containing the sea component in an amount less than 10% based on the total weight of the polymer components, having, in each multi-core composite fiber, a configuration wherein each island is surrounded by other islands and has peripheral surfaces facing approximately parallel to the peripheral surfaces of the other islands adjacent to said each island and having cross-sections of approximately quadrilateral or pentagonal shape in the islands positioned at the most outside portion of each of said fibers and of approximately quadrilateral to nonagonal shape in the inner islands surrounded by said outside islands;

impregnating the fibrous sheet with a solution or dispersion of a polymeric binder material, and then, coagulating or hardening the polymeric binder material, and thereafter;

subjecting the impregnated fibrous sheet to raising, said process forming a sheet-like material of the group consisting of non-woven and knitted sheet-like materials.

7. A process according to claim 6, wherein said island component polymer is polyethylene terephthalate or a copolymer thereof, said sea component polymer is polystyrene or a copolymer of styrene and another vinyl monomer, and the ratio of the intrinsic viscosity of polyethylene terephthalate to the intrinsic viscosity of the styrene polymer is in a range between 0.63 and 1.10.

8. A process according to claim 6, wherein said polymeric binder material is polyurethane.

9. A process according to claim 6, wherein said fibrous sheet has an apparent density of not less than 0.16 g/cm$^3$, before the impregnation of said polymeric binder material.

* * * * *